US009856659B1

(12) United States Patent
Paras

(10) Patent No.: US 9,856,659 B1
(45) Date of Patent: Jan. 2, 2018

(54) MOLDING SYSTEM AND METHOD OF INSTALLING MOLDING SYSTEM

(71) Applicant: John Paras, North Hollywood, CA (US)

(72) Inventor: John Paras, North Hollywood, CA (US)

( * ) Notice: Subject to any disclaimer, the term of this patent is extended or adjusted under 35 U.S.C. 154(b) by 0 days.

(21) Appl. No.: 15/284,442

(22) Filed: Oct. 3, 2016

(51) Int. Cl.
*E04F 19/04* (2006.01)
*E04G 21/14* (2006.01)

(52) U.S. Cl.
CPC ..... *E04F 19/0495* (2013.01); *E04G 21/14* (2013.01); *E04F 19/0436* (2013.01); *E04F 19/0459* (2013.01); *E04F 2019/0404* (2013.01); *E04F 2019/0409* (2013.01); *E04F 2019/0454* (2013.01)

(58) Field of Classification Search
CPC ..... E04F 19/0459; E04F 2019/0409; E04F 2019/0404; E04F 2019/0454; E04F 19/0495
See application file for complete search history.

(56) References Cited

U.S. PATENT DOCUMENTS 1,798,280 A * 3/1931 Sorensen ..... E04B 2/72 52/206
1,808,003 A 6/1931 New
4,622,791 A 11/1986 Cook et al.
5,333,433 A * 8/1994 Porambo ..... E04F 13/042 52/417
5,463,835 A * 11/1995 Wood ..... E04F 19/0436 52/288.1
5,544,463 A 8/1996 Bergin
5,891,282 A * 4/1999 Stough ..... B32B 29/02 156/71

(Continued)

FOREIGN PATENT DOCUMENTS

BE EP 1669514 A1 * 6/2006 ..... E04F 13/06
DE 10302961 A1 * 8/2004 ..... E04F 19/045
WO 9527110 A1 10/1995

OTHER PUBLICATIONS

Trim-Tex.com, Installation Instructions for Crown Moldings, http://www.trim-tex.com/files/2514/5563/9996/Crown_Molding_Installation_Instructions.pdf, Jul. 12, 2016, 2 pages.

(Continued)

*Primary Examiner* — Adriana Figueroa
(74) *Attorney, Agent, or Firm* — Cislo & Thomas, LLP

(57) ABSTRACT

A molding system comprising a decorative portion and a mounting flange for mounting the decorative portion directly to at least one wall stud. The decorative portion comprises a proximal portion, a distal portion, and a decorative front surface. The mounting flange comprises a proximal portion, the proximal portion being coupled to the distal portion of the decorative portion such that the mounting flange extends away from the decorative portion and a distal portion. The mounting flange has a longitudinal axis that is parallel to the longitudinal axis of the at least one wall stud and a thickness from about ¼ inches to about 2 inches. The distal portion of the first mounting flange abuts at least one sheet of drywall. The mounting flange does not substantially overlap the at least one sheet of drywall, and the at least one sheet of drywall does not substantially overlap the mounting flange.

17 Claims, 4 Drawing Sheets

(56) References Cited

U.S. PATENT DOCUMENTS

| | | | | |
|---|---|---|---|---|
| 6,253,510 | B1 * | 7/2001 | Santarossa | E04F 19/0436 428/69 |
| 6,910,307 | B1 * | 6/2005 | Maurer | E04F 19/0436 52/287.1 |
| 7,200,970 | B2 | 4/2007 | Koenig, Jr. et al. | |
| 7,730,683 | B2 | 6/2010 | Koenig, Jr. et al. | |
| 7,793,475 | B2 | 9/2010 | Riggs | |
| 7,997,043 | B1 | 8/2011 | MacMillan et al. | |
| 8,516,758 | B2 * | 8/2013 | Vaes | E04F 19/0436 52/287.1 |
| 2003/0014931 | A1 * | 1/2003 | Hahn | E04F 19/0436 52/287.1 |
| 2003/0070373 | A1 * | 4/2003 | Wong Hahn | E04F 19/0436 52/287.1 |
| 2003/0115813 | A1 * | 6/2003 | Wong Hahn | E04F 19/0436 52/288.1 |
| 2005/0210784 | A1 * | 9/2005 | Hahn | E04F 19/0436 52/287.1 |
| 2005/0252121 | A1 * | 11/2005 | Hahn | E04F 19/0436 52/287.1 |
| 2005/0257876 | A1 * | 11/2005 | Maurer | E04F 19/0436 156/71 |

OTHER PUBLICATIONS

Trim-Tex.com, Shower Bead Installation Instructions, http://www.trim-tex.com/files/5114/5624/1333/Shower_Bead_Inst_EN-SP.pdf, 2 pages.

* cited by examiner

MOLDING SYSTEM AND METHOD OF INSTALLING MOLDING SYSTEM

BACKGROUND

The present invention is directed to systems and methods for installing decorative molding in a building's interior space, and more particularly to a molding system and method of installing the molding system more quickly and easily in either a new construction or finished interior space.

It is often desirable for building's interior spaces to have decorative trim at the top and bottom of interior walls. Where the walls meet the ceiling the decorative trim is typically referred to as crown molding. Where the walls meet the floor, the decorative trim is typically referred to as base molding. When a building is being built, crown molding and base molding are usually installed after nearly all other construction is complete. The later timing of installation may be undesirable as there are usually many different types of finishing work that must be coordinated at the same time.

Further, crown molding and base molding can be added as a decorative addition to an interior space that is already completed and in use. Many times, this is done by individual homeowners to improve the appearance of the space. Installing crown molding and base molding can prove a difficult task for a nonprofessional installer. Also, because the molding is attached by fasteners through the decorative face, finishing work must be performed to fill holes.

The present invention overcomes several of the deficiencies, disadvantages and undesired parameters associated with the known molding designs and installation procedures.

SUMMARY

According to one embodiment of the present invention, there is provided a molding system comprising: a) a decorative portion comprising i) a proximal portion, ii) a distal portion, and iii) a decorative front surface; and b) a first mounting flange for mounting the decorative portion directly to at least one wall stud having a longitudinal axis, the first mounting flange comprising i) a proximal portion, the proximal portion being coupled to the distal portion of the decorative portion such that the first mounting flange extends away from the decorative portion; and ii) a distal portion, the first mounting flange having a longitudinal axis that is parallel to the longitudinal axis of the at least one wall stud and having a thickness from about ¼ inches to about 2 inches, and wherein the distal portion of the first mounting flange abuts at least one sheet of drywall, and the first mounting flange does not substantially overlap the at least one sheet of drywall, and the at least one sheet of drywall does not substantially overlap the first mounting flange. In one embodiment, the proximal portion of the decorative portion is disposed proximate the at least one wall stud, and the distal portion of the decorative portion extends away from the at least one wall stud. In another embodiment, the proximal portion of the decorative portion extends away from the at least one wall stud, and the distal portion of the decorative portion is disposed proximate the at least one wall stud. In another embodiment, the molding system further comprises an extension coupled to and extending away from the proximal portion of the decorative portion, such that a flat base is created. In another embodiment, the first mounting flange further comprises a channel disposed along an exterior surface of the first mounting flange. In another embodiment, the molding system further comprises one or more fasteners for securing the first mounting flange to the at least one wall stud.

In another embodiment of the present invention, the molding system comprises a) a decorative portion comprising i) a proximal portion; ii) a distal portion; and iii) a decorative front surface; and b) a first mounting flange for mounting the decorative portion directly to at least one wall stud having a longitudinal axis, the first mounting flange comprising i) a proximal portion; and ii) a distal portion coupled to the proximal portion of the decorative portion such that the first mounting flange extends vertically downward away from the decorative portion, the first mounting flange having a longitudinal axis that is parallel to the longitudinal axis of the at least one wall stud and having a thickness from about ¼ inches to about 2 inches, wherein the proximal portion of the first mounting flange abuts at least one sheet of drywall, and the first mounting flange does not substantially overlap the at least one sheet of drywall, and the at least one sheet of drywall does not substantially overlap the first mounting flange. In another embodiment, the first mounting flange further comprises a channel disposed along an exterior surface of the first mounting flange. In another embodiment, the molding system further comprises one or more fasteners for securing the first mounting flange to the at least one wall stud.

In another embodiment, the molding system further comprises a second mounting flange for mounting the molding system to at least one ceiling joist having a longitudinal axis, the second mounting flange comprising: a) a proximal portion coupled to the distal portion of the decorative portion, and b) a distal portion, such that the distal portion extends away from the decorative portion, the second mounting flange having a longitudinal axis that is parallel to the longitudinal axis of the at least one ceiling joist, wherein the distal portion of the second mounting flange is configured to abut the at least one sheet of drywall, and the second mounting flange does not substantially overlap the at least one sheet of drywall, and the at least one sheet of drywall does not substantially overlap the second mounting flange. In another embodiment, the longitudinal axis of the second mounting flange is perpendicular to the longitudinal axis of the at least one wall stud and the longitudinal axis of the first mounting flange. In another embodiment, the second mounting flange further comprises a channel disposed along an exterior surface of the second mounting flange. In another embodiment, the molding system further comprises one or more fasteners for securing the second mounting flange to the at least one ceiling joist.

In another embodiment of the present invention, the molding system further comprises a second mounting flange for mounting the molding system to at least one ceiling joist having a longitudinal axis, the second mounting flange comprising: a) a proximal portion coupled to the distal portion of the decorative portion; and b) a distal portion, such that the distal portion extends away from the decorative portion, the second mounting flange having a longitudinal axis that is perpendicular to the longitudinal axis of the at least one wall stud, wherein the distal portion of the second mounting flange is configured to abut the at least one sheet of drywall, and the second mounting flange does not substantially overlap the at least one sheet of drywall, and the at least one sheet of drywall does not substantially overlap the second mounting flange. In another embodiment, the second mounting flange further comprises a channel disposed along an exterior surface of the second mounting flange. In another embodiment, the molding system further comprises one or more fasteners for securing the second mounting flange to the at least one ceiling joist.

In one embodiment of the present invention, there is provided a method of installing a molding system, the method comprising the steps of: a) providing the molding system, wherein the molding system comprises a decorative portion comprising i) a proximal portion, ii) a distal portion, and iii) a decorative front surface; and a first mounting flange for mounting the decorative portion directly to at least one wall stud having a longitudinal axis, the first mounting flange comprising i) a proximal portion and ii) a distal portion coupled to the proximal portion of the decorative portion such that the first mounting flange extends vertically downward away from the decorative portion, the first mounting flange having a longitudinal axis that is parallel to the longitudinal axis of the at least one wall stud and having a thickness from about ¼ inches to about 2 inches, wherein the proximal portion of the first mounting flange abuts at least one sheet of drywall, and the first mounting flange does not substantially overlap the at least one sheet of drywall, and the at least one sheet of drywall does not substantially overlap the first mounting flange; and b) coupling the first mounting flange to one or more wall studs using one or more fasteners. In another embodiment, after step b), the method further comprises step c) coupling one or more sheets of drywall to the one or more wall studs such that an edge of the one or more dry wall sheets does not substantially overlap the first mounting flange, and the first mounting flange does not substantially overlap the one or more sheets of drywall, thereby creating a seam. In another embodiment, after step c), the method further comprises step d) finishing the seam by applying tape and mud over the seam.

In another embodiment of the present invention, there is provided a method of installing a molding system, the method comprising the steps of: a) providing the molding system, wherein the molding system comprises a decorative portion comprising i) a proximal portion; ii) a distal portion; and iii) a decorative front surface; and a first mounting flange for mounting the decorative portion directly to at least one wall stud having a longitudinal axis, the first mounting flange comprising i) a proximal portion; and ii) a distal portion coupled to the proximal portion of the decorative portion such that the first mounting flange extends vertically downward away from the decorative portion, the first mounting flange having a longitudinal axis that is parallel to the longitudinal axis of the at least one wall stud and having a thickness from about ¼ inches to about 2 inches; wherein the proximal portion of the first mounting flange abuts at least one sheet of drywall, and the first mounting flange does not substantially overlap the at least one sheet of drywall, and the at least one sheet of drywall does not substantially overlap the first mounting flange; and wherein the molding system further comprises a second mounting flange for mounting the molding system to at least one ceiling joist having a longitudinal axis, the second mounting flange comprising a proximal portion coupled to the distal portion of the decorative portion; and a distal portion, such that the distal portion extends away from the decorative portion, the second mounting flange having a longitudinal axis that is perpendicular to the longitudinal axis of the at least one wall stud; wherein the distal portion of the second mounting flange is configured to abut the at least one sheet of drywall, and the second mounting flange does not substantially overlap the at least one sheet of drywall, and the at least one sheet of drywall does not substantially overlap the second mounting flange; b) coupling the first mounting flange to one or more wall studs using one or more fasteners; and c) coupling the second mounting flange to the one or more ceiling joists using one or more fasteners.

DRAWINGS

These and other features, aspects and advantages of the present invention will become better understood with regard to the following description, appended claims and accompanying figures where:

DESCRIPTION

As used herein, the following terms and variations thereof have the meanings given below, unless a different meaning is clearly intended by the contest in which such term is used.

The terms "a," "an," and "the" and similar referents used herein are to be construed to cover both the singular and the plural unless their usage in context indicates otherwise.

As used in this disclosure, the term "comprise" and variations of the term, such as "comprising" and "comprises," are not intended to exclude other additives, components, integers ingredients or steps.

Figure 1:
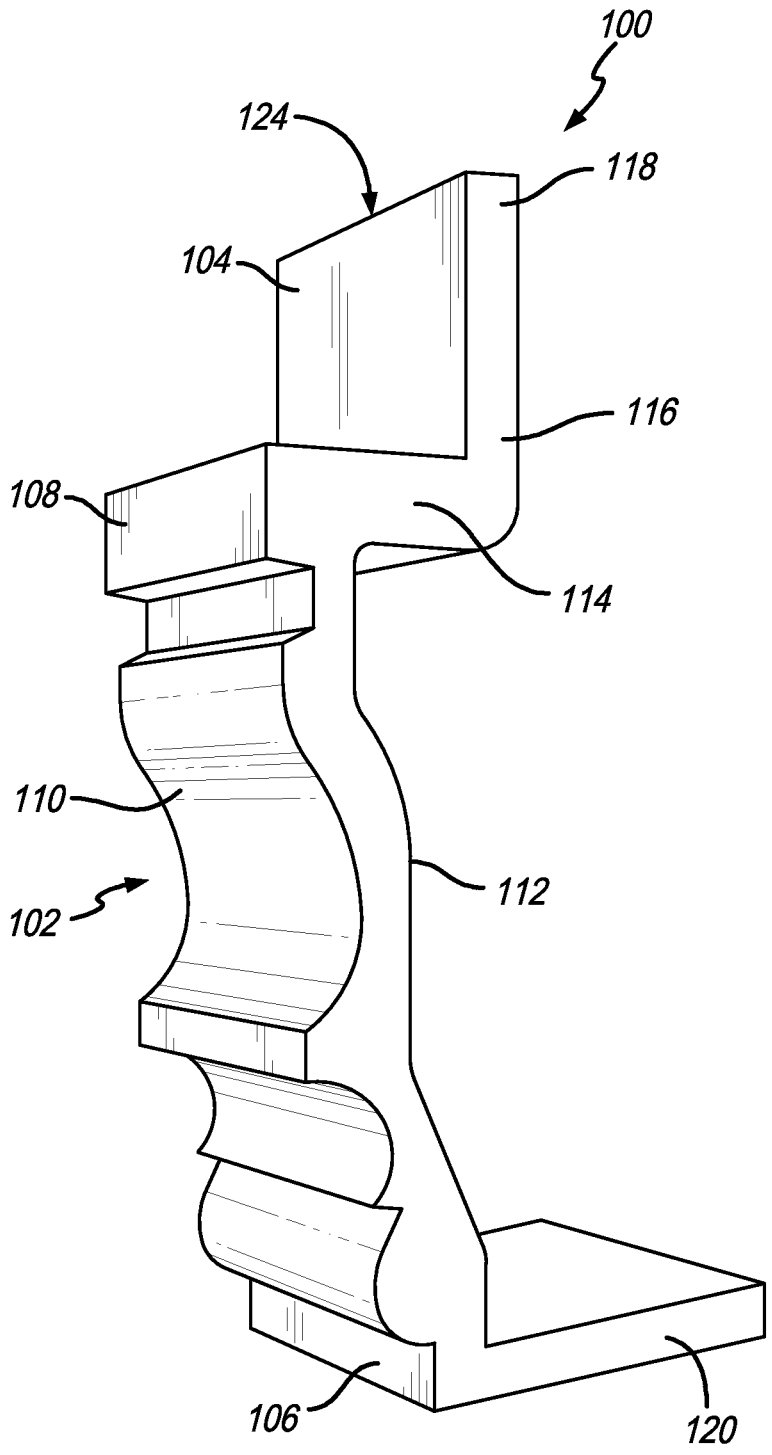
FIG. 1 is a perspective view of a first molding system according to the present invention, wherein the molding system is door or window trim molding.

Referring now to FIG. 1, there is shown a first molding system 100 according to the present invention. The first molding system 100 is representative of door or window trim molding and comprises a decorative portion 102 and a mounting flange 104. In the field of construction and finish work, a person of ordinary skill in the art would refer to the mounting flange 104 as the reveal of the molding system 100.

Typically, the decorative portion 102 comprises a proximal portion 106, a distal portion 108, a decorative front surface 110, and a back surface 112. The decorative portion 102 can be any shape and design desired by the user. Typically, the decorative portion 102 is from about ¼ inches to about 5 inches thick, from about 2 inches to about 9 inches tall, and can be any width such that the decorative portion 102 runs substantially the entire length of the first molding system 100. As shown in FIG. 1, the proximal portion 106 can be disposed more proximate to a vertical wall surface (not shown) and the distal portion 108 can extend away from the vertical wall surface, such that a gap is formed between the back surface 112 of the decorative portion 102 and the vertical wall surface. Optionally, the first molding system 100 can further comprise a foam backing (not shown), that increases its thickness.

Accordingly, as shown in FIG. 1, the first molding system 100 can optionally require a first extension 114 to couple the decorative portion 102 to the mounting flange 104. The first extension 114 comprises a longitudinal axis that is typically perpendicular to the longitudinal axis of the mounting flange 104 and the vertical wall surface, although it is not required to be. Alternatively, the longitudinal axis of the first extension 114 can be at any angle with respect to the longitudinal axis of the mounting flange 104 and the vertical wall surface. The first extension 114 is from about ¼ inches to about 2 inches thick, from about ¼ inches to about 3 inches long/deep, and can be any width such that the first extension 114 runs substantially the entire length of the first molding system 100.

Alternatively, both the proximal and distal portions 106, 108 of the decorative portion 102 can be disposed proximate to the vertical wall surface, or the decorative portion 102 can have a thickness such that the back surface 112 is disposed proximate to the vertical wall surface. Either of these scenarios could result in no substantial gap being formed between the back surface 112 of the decorative portion 102 and the vertical wall surface, rendering the first extension 114 unnecessary.

The mounting flange 104 comprises a longitudinal axis that is parallel to the longitudinal axis of a vertical wall that the molding system 100 can be mounted to. The mounting flange 104 also comprises a proximal portion 116 and a distal portion 118. As shown in FIG. 1, the proximal portion 116 of the mounting flange 104 is coupled to one end of the first extension 114, and the other end of the first extension 114 is coupled to the distal portion 108 of the decorative portion 102. The distal portion 118 of the mounting flange 104 extends vertically away from the decorative portion 102, forming a flat, planar surface 124 to ultimately meet and abut one or more sheets of dry wall (not shown), or any other material being used to create a wall surface, such as, but not limited to, concrete slab, plywood, sheet rock, bead board, shiplap, plaster and lath, and wood paneling.

The mounting flange 104 has a substantially uniform cross-section, or thickness, along the entire mounting flange 104 that is similar in thickness to the one or more sheets of drywall that can be installed proximate to the mounting flange 104. The mounting flange 104 is from about ¼ inches to about 2 inches thick, from about ½ inch to about 4 inches tall, and can be any width such that the mounting flange 104 runs substantially the entire length of the first molding system 100. Typically, the mounting flange 104 is ⅝ inches thick. The distal portion 118, and therefore the flat, planar surface 124 of the mounting flange 104 and the one or more sheets of dry wall can be disposed proximate each other and can abut, forming a substantially flush seam. There can be direct contact between the distal portion 118, and therefore the flat, planar surface 124 of the mounting flange 104 and the one or more sheets of dry wall, but there is no substantial overlap between any portion of the mounting flange 104 and the one or more sheets of drywall. More specifically, the mounting flange 104 comprises an interior surface disposed proximate the wall surface and an exterior surface disposed towards an interior of a room being finished. The interior surface of the mounting flange 104 does not overlap the at least one sheet of dry wall, and the at least one sheet of drywall does not overlap the exterior surface of the mounting flange 104.

Optionally, the first molding system 100 can also comprise a second extension 120. The second extension 120 is coupled to and extends away from to the proximal portion 106 of the decorative portion 102. The second extension 120 comprises a longitudinal axis that is perpendicular to the longitudinal axis of the vertical wall surface (not shown). Optionally, the second extension 120 can comprise a longitudinal axis that is at any angle with respect to the longitudinal axis of the vertical wall surface. The second extension 120 is from about ¼ inches to about 2 inches thick, from about 2 inches to about 8 inches long/deep, and can be any width such that the second extension 120 runs substantially the entire length of the first molding system 100. The second extension 120 extends into the door jam or window sill, to create a clean, finished look.

Figure 2:
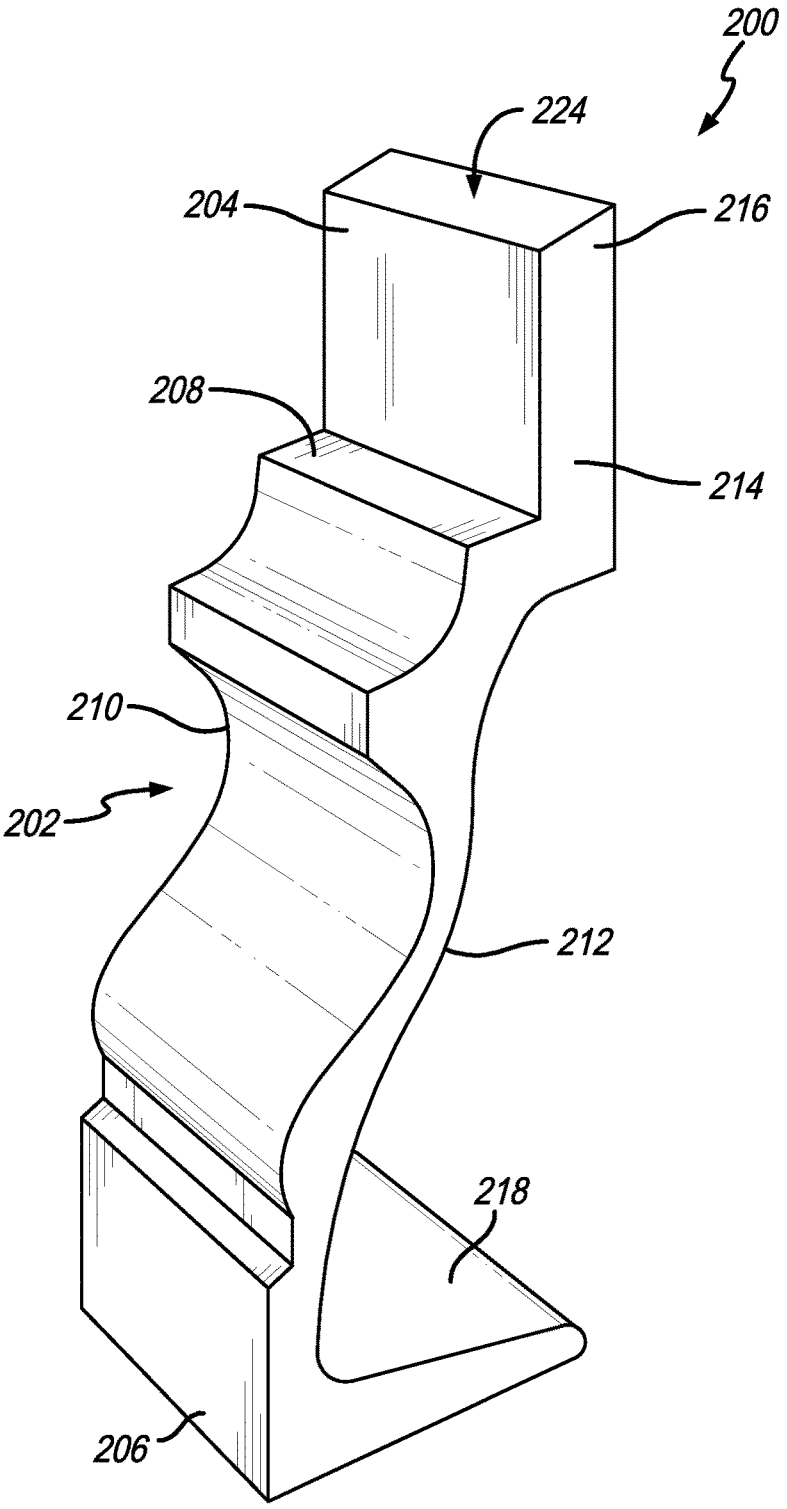
FIG. 2 is a perspective view of a second molding system according to the present invention, wherein the molding system is base molding.

Referring now to FIG. 2, there is shown a second molding system 200 according to the present invention. The second molding system 200 is representative of base molding and comprises a decorative portion 202 and a mounting flange 204.

Typically, the decorative portion 202 comprises a proximal portion 206, a distal portion 208, a front decorative surface 210 and a back surface 212. The decorative portion 202 can be any shape and design desired by the user. Typically, the decorative portion 202 is from about ¼ inches to about 5 inches thick, from about 2 inches to about 9 inches tall, and can be any width such that the decorative portion 202 runs substantially the entire length of the second molding system 200. Optionally, the second molding system 200 can further comprise a foam backing (not shown), that increases its thickness.

As shown in FIG. 2, distal portion 208 can be disposed more proximate to a vertical wall surface (not shown) and the proximal portion 206 can extend away from the vertical wall surface, such that a gap is formed between the back surface 212 of the decorative portion 202 and the vertical wall surface.

Figure 6:
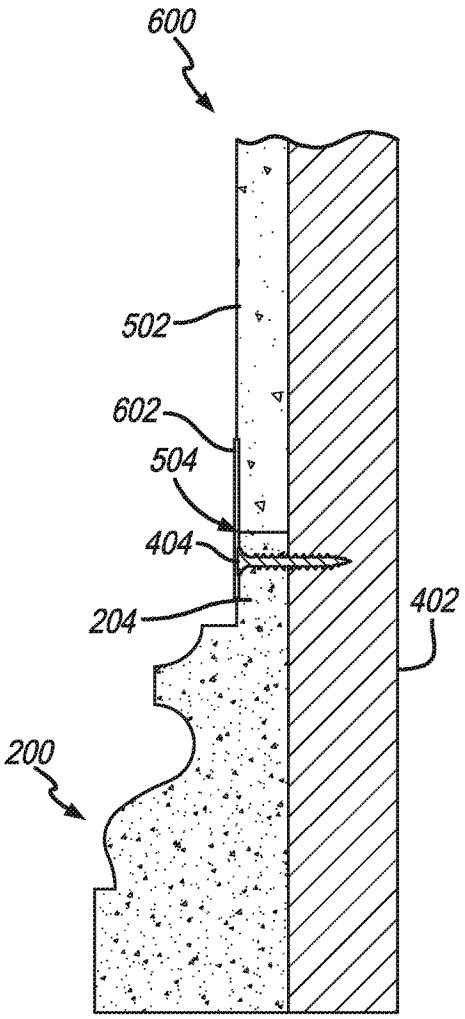
FIG. 6 is a side elevation view of a third step of installation of the molding system of FIG. 2.
Figure 5:
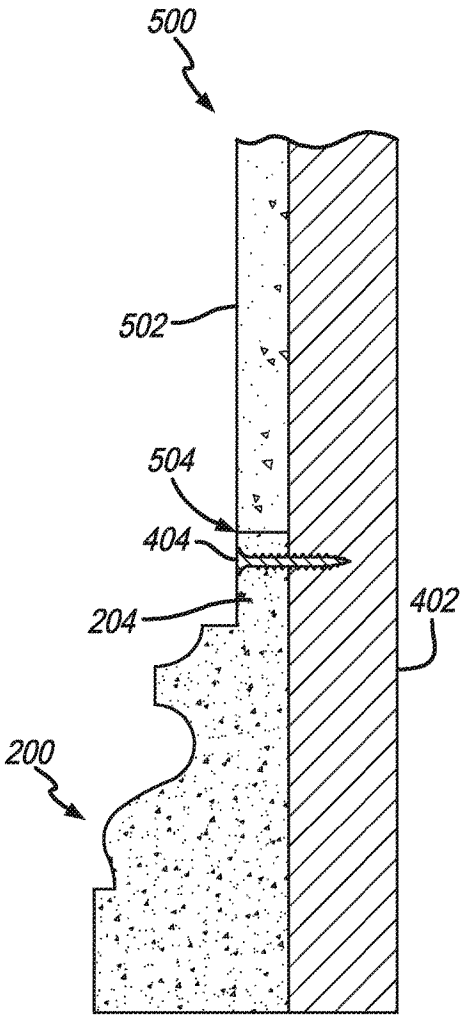
FIG. 5 is a side elevation view of a second step of installation of the molding system of FIG. 2.
Figure 4:
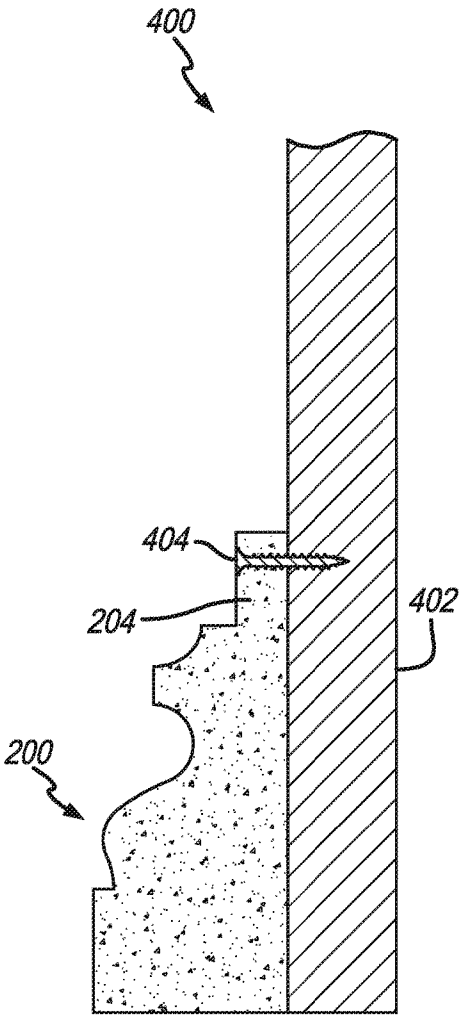
FIG. 4 is a side elevation view of a first step of installation of the molding system of FIG. 2.

Alternatively, both the proximal and distal portions 206, 208 of the decorative portion 202 can be disposed proximate to the vertical wall surface, or the decorative portion 202 can have a thickness such that the back surface 212 is disposed proximate to the vertical wall surface (as shown in FIGS. 4-6). Either of these scenarios could result in no substantial gap being formed between the back surface 212 of the decorative portion 202 and the vertical wall surface.

The mounting flange 204 comprises a longitudinal axis that is parallel to the longitudinal axis of the vertical wall that the second molding system 200 can be mounted to. The mounting flange 204 also comprises a proximal portion 214 and a distal portion 216. As shown in FIG. 2, the proximal portion 214 of the mounting flange 204 is coupled to the distal portion 208 of the decorative portion 202. The distal portion 216 of the mounting flange 204 extends vertically away from the distal portion 208 of the decorative portion 202, forming a flat, planar surface 224 to ultimately meet and abut one or more sheets of dry wall (not shown).

The mounting flange 204 has a substantially uniform cross-section, or thickness, along the entire mounting flange 204 that is similar in thickness to the one or more sheets of drywall that can be installed proximate to the mounting flange 204. The mounting flange 204 is from about ¼ inches to about 2 inches thick, from about ½ inch to about 4 inches tall, and can be any width such that the mounting flange 204 runs substantially the entire length of the second molding system 200. Typically, the mounting flange 204 is ⅝ inches thick. The mounting flange 204 and the one or more sheets of dry wall can be disposed proximate each other and the flat, planar surface 224 and the one or more sheets of drywall can abut, forming a substantially flush seam. There can be direct contact between the distal portion 216 of the mounting flange 204 and the one or more sheets of dry wall, but there is no substantial overlap between any portion of the mounting flange 204 and the one or more sheets of drywall. More specifically, the mounting flange 204 comprises an interior surface disposed proximate the wall surface and an exterior surface disposed towards an interior of a room being finished. The interior surface of the mounting flange 204 does not overlap the at least one sheet of dry wall, and the at least one sheet of drywall does not overlap the exterior surface of the mounting flange 204.

Optionally, the second molding system 200 can also comprise an extension 218. The extension 218 is coupled to and extends away from to the proximal portion 206 of the decorative portion 202. The extension 218 comprises a longitudinal axis that is perpendicular to the longitudinal axis of the vertical wall surface (not shown). Optionally, the extension 218 can comprise a longitudinal axis that is at any angle with respect to the longitudinal axis of the vertical wall surface. The extension 218 is not necessary to the second molding system 200, but does provide the benefit of a flat base for the second molding system 200 to securely rest on while being installed. The extension 218 is from about ¼ inches to about 2 inches thick, from about 1 inch to about 5 inches long/deep, and can be any width such that the extension 218 runs substantially the entire length of the second molding system 200.

Figure 3:
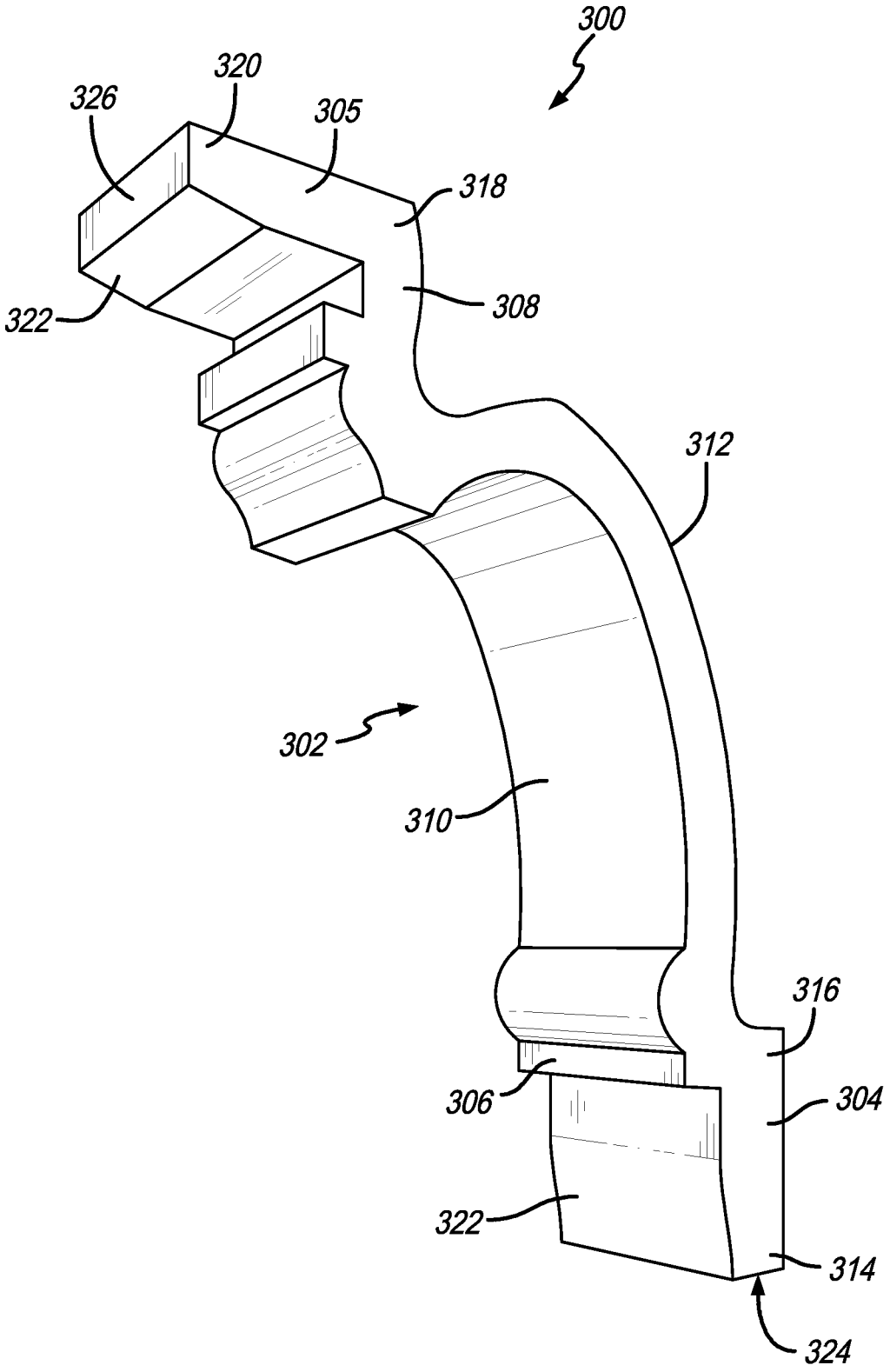
FIG. 3 is a perspective view of a third molding system according to the present invention, wherein the molding system is crown molding.

Referring now to FIG. 3, there is shown a third molding system 300 according to the present invention. The third molding system 300 is representative of crown molding and comprises a decorative portion 302, a first mounting flange 304, and a second mounting flange 305. Typically, the decorative portion 302 comprises a proximal portion 306, a distal portion 308, a decorative front surface 310 and a back surface 312. The decorative portion 302 can be any shape and design desired by the user. Typically, the decorative portion 302 is from about ¼ inches to about 7 inches thick, from about 3 inches to about 10 inches tall, and can be any width such that the decorative portion 302 runs substantially the entire length of the third molding system 300. Optionally, the third molding system 300 can further comprise a foam backing (not shown), that increases its thickness.

As shown in FIG. 3, proximal portion 306 can be disposed more proximate to a vertical wall surface (not shown) and the distal portion 308 can extend away from the vertical wall surface, such that a gap is formed between the back surface 312 of the decorative portion 302 and both a ceiling surface (not shown) and the vertical wall surface.

Alternatively, both the proximal and distal portions 306, 308 of the decorative portion 302 can be disposed proximate to the vertical wall surface, or the decorative portion 302 can have a thickness such that the back surface 312 is disposed proximate to the vertical wall surface. Either of these scenarios could result in no substantial gap being formed between the back surface 312 of the decorative portion 302 and the vertical wall surface.

The first mounting flange 304 comprises a longitudinal axis that is parallel to the longitudinal axis of a vertical wall that the third molding system 300 can be mounted to. The first mounting flange 304 also comprises a proximal portion 314 and a distal portion 316. As shown in FIG. 3, the distal portion 316 of the first mounting flange 304 is coupled to the proximal portion 306 of the decorative portion 302. The proximal portion 314 of the first mounting flange 304 extends vertically downward away from the proximal portion 306 of the decorative portion 302, forming a flat, planar surface 324 to ultimately meet and abut one or more sheets of dry wall (not shown).

The second mounting flange 305 comprises a longitudinal axis that is typically perpendicular to the longitudinal axis of the vertical wall, and parallel to the longitudinal axis of the ceiling surface that the third molding system 300 can be mounted to. The second mounting flange 305 also comprises a proximal portion 318 and a distal portion 320. As shown in FIG. 3, the proximal portion 318 of the second mounting flange 306 is coupled to the distal portion 308 of the decorative portion 302. The distal portion 320 of the second mounting flange 305 typically extends horizontally away from the distal portion 308 of the decorative portion 302, forming a flat, planar surface 326 to ultimately meet and abut one or more sheets of dry wall (not shown). Alternatively, the second mounting flange 305 can extend away from the distal portion 308 of the decorative portion 302 at any angle with respect to the longitudinal axis of the vertical wall surface, in the event that the ceiling surface is not perpendicular to the longitudinal axis of the vertical wall surface.

The first and second mounting flanges 304, 305 each have a cross-section substantially uniform in thickness along the entire first and second mounting flanges 304, 305, resulting in thicknesses that are similar to the thickness of the sheets of drywall that can be installed proximate to the first and second mounting flanges 304, 305. The first and second mounting flanges 304, 305 each are from about ¼ inches to about 2 inches thick, from about ½ inch to about 4 inches long/tall, and can be any width such that the first and second mounting flanges 304, 305 run substantially the entire length of the third molding system 300. The first and second mounting flanges 304, 305 and the one or more sheets of dry wall can be disposed proximate each other and the flat, planar surfaces 324, 326 can abut the one or more sheets of drywall, forming a substantially flush seam. There can be direct contact between the proximal portion 314 of the first mounting flange 304 and the one or more sheets of dry wall, and there can be direct contact between the distal portion 320 of the second mounting flange 305 and the one or more sheets of dry wall, but there is no substantial overlap between any portion of the first or second mounting flanges 304, 305 and the one or more sheets of drywall. More specifically, each mounting flange 304, 305 comprises an interior surface disposed proximate the wall surface or ceiling surface (as appropriate), and an exterior surface disposed towards an interior of a room being finished. The interior surface of each mounting flange 304, 305 does not overlap the at least one sheet of dry wall, and the at least one sheet of drywall does not overlap the exterior surfaces of the mounting flanges 304, 305.

Optionally, as shown in FIG. 3, the mounting flanges 304, 305 comprise two opposed ends 314, 316, 318, 320. The end 316, 318 coupled to the extension 114, or the decorative portion 306 is substantially uniform in thickness. The other opposed end 314, 320 is slightly tapered 322 along an exterior surface, such that when the molding system 100, 200, 300 is installed, and the one or more sheets of dry wall are installed proximate to the mounting flanges 104, 204, 304, 305, a depression is created, permitting the installer to easily finish the seam by mudding and taping the seam, which now lies in somewhat of a depression. This provides the added benefit of creating a substantially flat and even surface when the seam is finished because the added mud and tape are disposed in a depression. It should be noted that the mounting flanges 104, 204, can also comprise a taper 322, and the taper 322 is not just limited to the third molding system 300. The tapers 322 can be any dimension, but typically the tapers 322 are from about ¼ inch to about 1 inch thick. The taper 322 must have a thickness that is smaller than the thickness of the mounting flange 104, 204, 304, 305 that the taper 322 is disposed along.

The first, second and third molding systems 100, 200, 300 each have a total thickness from about ½ inch to about 8 inches, a height from about 2 inches to about 10 inches, and can be any width such that they run as long as necessary to trim a room it is being installed in. The first, second and third molding systems 100, 200, 300 can be made from gypsum plaster, fiberglass, fiberglass reinforced gypsum, concrete, pre-cast concrete, plastic, wood, particle board, carbon fiber, metal, and aluminum.

Referring now to FIGS. 4 through 6, there is shown a method of installing the second molding system 200. It should be noted that this general method of installation can also be applied to the first and third molding systems 100, 300 as well.

Referring now to FIG. 4, there is shown a first step 400 of installing the second molding system 200. The second molding system 200 is placed up against one or more wall studs 402. The one or more wall studs 402 can comprise any material, but typically comprise metal, wood or concrete. The second molding system 200 is then secured to the one or more wall studs 402 by one or more fasteners 404. The one or more fasteners 404 are inserted through the mounting flange 204 to secure the second molding system 200 to the one or more wall studs 402. The one or more fasteners 402 can be any fastener such as, for example, screws, drywall screws, concrete slab screws, metal stud screws, nails, staples, and fasteners.

When the first molding system 100 is installed, the first molding system 100 is held in place up against the one or more wall studs 402, and one or more fasteners 402 are inserted through the mounting flange 104 to secure the first molding system 100 to the one or more wall studs 402.

When the third molding system 300 is installed, the third molding system 300 is held in place up against one or more wall studs 402, and one or more fasteners 404 are inserted through the first mounting flange 304 to secure the third molding system 300 to the one or more wall studs 402. Next, one or more fasteners 404 are inserted through the second mounting flange 305 to secure the third molding system 300 to one or more ceiling joists (not shown).

Referring now to FIG. 5, there is shown a second step 500 of installing the second molding system 200. One or more sheets of drywall 502 are then placed up against the one or more wall studs 402, proximate the mounting flange 204. Where the mounting flange 204 and the one or more sheets of dry wall 502 meet, a substantially flush seam 504 is formed.

Referring now to FIG. 6, there is shown a third step 600 of installing the second molding system 200. One or more strips of tape and mud 602 are placed over the seam 504 formed by the joining of the mounting flange 204 and the one or more sheets of dry wall 502, sealing off and finishing the seam 502.

The benefits of the present invention in new construction include also process and timing benefits. Because the molding systems 100, 200, 300 are installed directly to a wall's support structure (e.g., wall studs), they can be installed before the wall panels and/or drywall are installed. This could be accomplished while other tasks (such as electrical work, plumbing, insulation, etc.) are being performed that require the open wall structure. Additionally, because the molding systems 100, 200, 300 can be installed first, the molding systems 100, 200, 300 are installed level and straight. This means that the mounting flange 104, 204, 304, 305 provides a level even surface up against which the one or more sheets of dry wall (or whatever wall material is being installed) are installed. The added step of having to level and straighten the dry wall sheets is removed from the typical installation procedure.

This also means that adding crown molding to a new project may not mean adding time to the overall project. Further, the ceiling installation no longer needs to wait for the walls to be finished, saving process time. However, if desired, the molding systems 100, 200, 300 can also be installed after the ceiling and/or dry wall (or whatever wall material is being installed) are installed.

Another way the present invention saves time is by a lack of finishing work required. None of the fasteners used to affix the molding system 100, 200, 300 ever go through the decorative portion. This saves considerable time and labor. Also, the molding system 100, 200, 300 can be painted before it is installed, since the decorative portion 102, 202, 302 is never violated by the installation process.

Although the present invention has been described in considerable detail with reference to certain preferred embodiments, other embodiments are possible. The steps disclosed for the present methods, for example, are not intended to be limiting nor are they intended to indicate that each step is necessarily essential to the method, but instead are exemplary steps only. Therefore, the scope of the appended claims should not be limited to the description of preferred embodiments contained in this disclosure. All references cited herein are incorporated by reference in their entirety.

What is claimed is:

1. A molding system configured for installation prior to installation of at least one sheet of drywall, the molding system comprising:

a) a decorative portion comprising:
  i) a proximal portion;
  ii) a distal portion; and
  iii) a decorative front surface;

b) a first mounting flange for mounting the decorative portion directly to at least one wall stud having a longitudinal axis, the first mounting flange extending away from the decorative portion and comprising:
  i) two opposed ends comprising:
    a) a proximal portion; and
    b) a distal portion;
  ii) a longitudinal axis that is parallel to the longitudinal axis of the at least one wall stud; and
  iii) a cross section substantially uniform in thickness along the entire first mounting flange; and c) a first extension comprising two opposed ends, wherein one end is coupled to either the proximal portion or the distal portion of the decorative portion, and the other opposed end is coupled to one of the opposed ends of the first mounting flange such that a step is created where the decorative portion couples to the first mounting flange;

wherein the opposed end of the first mounting flange not coupled to the extension comprises a flat, planar surface configured to abut at least one sheet of drywall and form a substantially flush seam between the first mounting flange and the at least one sheet of drywall, and an interior surface of the first mounting flange does not substantially overlap the at least one sheet of drywall, and the at least one sheet of drywall does not substantially overlap an exterior surface of the first mounting flange.

2. The molding system of claim 1, wherein the proximal portion of the decorative portion is disposed proximate the at least one wall stud, and the distal portion of the decorative portion extends away from the at least one wall stud.

3. The molding system of claim 1, wherein the proximal portion of the decorative portion extends away from the at least one wall stud, and the distal portion of the decorative portion is disposed proximate the at least one wall stud.

4. The molding system of claim 3, further comprising a second extension coupled to and extending away from the proximal portion of the decorative portion towards the at least one wall stud, such that a flat base is created.

5. The molding system of claim 1, wherein the opposed end of the first mounting flange coupled to the first extension is substantially uniform in thickness and the other opposed end not coupled to the first extension is slightly tapered.

6. The molding system of claim 1, further comprising one or more fasteners for securing the first mounting flange to the at least one wall stud.

7. A molding system configured for installation prior to installation of at least one sheet of drywall, the molding system comprising:

a) a decorative portion comprising:
  i) a proximal portion;
  ii) a distal portion; and
  iii) a decorative front surface;

b) a first mounting flange for mounting the decorative portion directly to at least one wall stud having a longitudinal axis, the first mounting flange extending vertically downward away from the decorative portion and comprising:
  i) two opposed ends comprising:
    a) a proximal portion;
    b) a distal portion;
  ii) a longitudinal axis that is parallel to the longitudinal axis of the at least one wall stud; and
  iii) a cross section substantially uniform in thickness along the entire first mounting flange;

c) a first extension comprising two opposed ends, wherein one end is coupled to the proximal portion of the decorative portion, and the other opposed end is coupled to the distal portion of the first mounting flange such that the first mounting flange is receded with respect to the decorative portion such that a step is created where the decorative portion couples to the first mounting flange; and d) a second mounting flange for mounting the molding system to at least one ceiling joist having a longitudinal axis, the second mounting flange having a longitudinal axis that is parallel to the longitudinal axis of the ceiling joist, the second mounting flange comprising:
  i) a proximal portion coupled to the distal portion of the decorative portion;
  ii) a distal portion, such that the distal portion extends horizontally away from the decorative portion; and
  iii) a cross section substantially uniform in thickness along the entire second mounting flange;
  wherein the proximal portion of the first mounting flange and the distal portion of the second mounting flange each comprise a flat, planar surface configured to abut at least one sheet of drywall and form a substantially flush seam between the first and second mounting flanges and their respective at least one sheet of drywall, and an interior surface of the first mounting flange does not substantially overlap the at least one sheet of drywall, and the at least one sheet of drywall does not substantially overlap an exterior surface of the first mounting flange, and an interior surface of the second mounting flange does not substantially overlap the at least one sheet of drywall, and the at least one sheet of drywall does not substantially overlap an exterior surface of the second mounting flange.

8. The molding system of claim 7, wherein the distal portion of the first mounting flange coupled to the first extension is substantially uniform in thickness and the proximal portion of the first mounting flange is slightly tapered.

9. The molding system of claim 7, further comprising one or more fasteners for securing the first mounting flange to the at least one wall stud.

10. The molding system of claim 7, wherein the longitudinal axis of the second mounting flange is perpendicular to the longitudinal axis of the at least one wall stud and the longitudinal axis of the first mounting flange.

11. The molding system of claim 7, wherein the proximal portion of the second mounting flange is substantially uniform in thickness, and the distal portion of the second mounting flange is slightly tapered.

12. The molding system of claim 7, further comprising one or more fasteners for securing the second mounting flange to the at least one ceiling joist.

13. The molding system of claim 7, wherein the proximal portion of the second mounting flange is substantially uniform in thickness, and the distal portion of the second mounting flange is slightly tapered.

14. The molding system of claim 7, further comprising one or more fasteners for securing the second mounting flange to the at least one ceiling joist.

15. A method of installing a molding system prior to installation of at least one sheet of drywall, the method comprising the steps of:

a) providing a molding system comprising:
  i) a decorative portion comprising:
    a) a proximal portion;
    b) a distal portion; and
    c) a decorative front surface;
  ii) a first mounting flange for mounting the decorative portion directly to at least one wall stud having a longitudinal axis, the first mounting flange extending away from the decorative portion and comprising:
    a) two opposed ends comprising:
      i) a proximal portion; and
      ii) a distal portion;
    b) a longitudinal axis that is parallel to the longitudinal axis of the at least one wall stud; and
    c) a cross section substantially uniform in thickness along the entire first mounting flange; and
  iii) a first extension comprising two opposed ends, wherein one end is coupled to either the proximal portion or the distal portion of the decorative portion, and the other opposed end is coupled to one of the opposed ends of the first mounting flange such that a step is created where the decorative portion couples to the first mounting flange;
  wherein the opposed end of the first mounting flange not coupled to the extension comprises a flat, planar surface configured to abut at least one sheet of drywall and form a substantially flush seam between the first mounting flange and the at least one sheet of drywall such that an interior surface of the first mounting flange does not substantially overlap the at least one sheet of drywall, and the at least one sheet of drywall does not substantially overlap an exterior surface of the first mounting flange;

b) coupling the first mounting flange to one or more wall studs using one or more fasteners; and c) after steps a) and b), coupling one or more sheets of drywall to the one or more wall studs such that the one or more sheets of drywall do not substantially overlap the first mounting flange, and the first mounting flange does not substantially overlap the one or more sheets of drywall, thereby creating a substantially flush seam.

16. The method of claim 15, wherein after step c), further comprising step d) finishing the seam by applying tape and mud over the seam.

17. A method of installing a molding system prior to installation of at least one sheet of drywall, the method comprising the steps of:

a) providing the molding system according to claim 7;

b) coupling the first mounting flange to one or more wall studs using one or more fasteners;

c) coupling the second mounting flange to the one or more ceiling joists using one or more fasteners; and d) after steps a)-c), coupling one or more sheets of drywall to the one or more wall studs such that an edge of the one or more sheets of drywall do not substantially overlap the first mounting flange, and the first mounting flange does not substantially overlap the one or more sheets of drywall, thereby creating a substantially flush seam.

* * * * *